United States Patent [19]

Black, Jr. et al.

[11] Patent Number: 5,021,270

[45] Date of Patent: Jun. 4, 1991

[54] METHOD FOR IMPROVING MOISTURE BARRIER PROTECTION AND ELECTROSTATIC DISCHARGE PROTECTION OF A COMPOSITE MATERIAL CASED ROCKET MOTOR

[75] Inventors: Robert E. Black, Jr., Newark, Del.; Don C. Carson, North East, Md.; Frederick W. Van Name, Newark, Del.

[73] Assignee: Thiokol Corporation, Ogden, Utah

[21] Appl. No.: 448,741

[22] Filed: Dec. 11, 1989

[51] Int. Cl.[5] ..... F02F 7/00; B05D 3/06; B05D 7/22; B05D 90/04

[52] U.S. Cl. ..... 428/34.1; 428/34.6; 220/415; 220/454; 220/457; 48/DIG. 3; 60/200.1; 427/53.1; 427/44; 427/205; 427/238; 427/407.1

[58] Field of Search ..... 427/54.1, 238, 140, 427/407.1, 407.3, 412.3, 53.1, 55, 56.1, 41, 44, 45.1, 205; 60/200.1; 220/3, 415, 454, 457; 48/174, 175, 179, DIG. 3; 428/34.1, 34.6

[56] References Cited

U.S. PATENT DOCUMENTS

| | | | |
|---|---|---|---|
| 2,730,462 | 1/1956 | Ewing | 427/238 |
| 3,042,546 | 7/1962 | Henningsen | 427/238 |
| 4,017,323 | 4/1977 | Gannon | 427/238 |
| 4,091,124 | 5/1978 | Reighter | 427/238 |
| 4,338,353 | 7/1982 | Melchior | 427/45.1 |
| 4,911,795 | 3/1990 | Olliff, Jr. | 204/4 |

*Primary Examiner*—Norman Morgenstern
*Assistant Examiner*—Marianne Padgett
*Attorney, Agent, or Firm*—Parmelee, Bollinger & Bramblett

[57] ABSTRACT

The moisture or water vapor barrier protection of a composite pressure vessel suitable for use as a composite cased solid propellant rocket motor is improved by immersing the pressure vessel, during pressure testing thereof, in a curable liquid polymer solution, optionally containing electrically conductive material such as metallic flakes or powder, so that the solution may flow into open voids, cracks or fractures in the pressure vessel and subsequently curing the curable liquid polymer in said voids, cracks or fractures.

36 Claims, No Drawings

METHOD FOR IMPROVING MOISTURE BARRIER PROTECTION AND ELECTROSTATIC DISCHARGE PROTECTION OF A COMPOSITE MATERIAL CASED ROCKET MOTOR

FIELD OF THE INVENTION

This invention relates to a method of improving the moisture barrier protection and electrostatic discharge protection in rocket motors, and more particularly, to such motors that are encased in a composite or filament-wound material.

BACKGROUND OF THE INVENTION

Solid propellant rocket motors are known in the prior art in which the casing for the propellant is fabricated from strong filaments in a matrix of a curable polymer. A casing made in this way is known as a composite or filament-wound casing. Because of the nature of the composite material, water vapor from the atmosphere, over a long period of time, can permeate the casing. Permeation of the casing with water vapor can cause the propellant bond to the motor case and/or intermediate liner between the case and propellant to fail. Such failure results in an unusable rocket motor. If used, the rocket motor can fail catastrophically. The presence of moisture in the casing also reduces the strength of the resin.

A metal foil has been the most effective known barrier against such water vapor or moisture permeation. The application of a metal coating of sufficient thickness (about 0.003 inches or 0.008 centimeters, minimum) to a rocket motor composite casing is difficult, however, and presents a number of problems. First, for reasons of safety, ion-vapor deposition of a metal to the composite casing followed by a plating process cannot be effected after the rocket motor casing has been loaded with propellant. Nor can such metallic coating processes be performed on the motor casing before loading of the propellant. This is because of degradation of the casing that could result from the processing after the casing has been certified after pressure testing. The coating cannot be applied before certification with pressure testing because the pressure testing would result in expansion of the casing sufficiently to tear and debond the metallic coating, thus rendering it useless as a barrier against moisture permeation.

A preformed metallic coating adhesively applied to the surface of a rocket motor composite casing after loading could provide an effective barrier to water vapor permeation through the casing. Attempts to use such preformed coatings, however, have also been beset with problems, particularly with respect to the application of such preformed coatings to the ends of the casing which normally comprise a hemispherical dome of generally spherical shape.

For the cylindrical surfaces of the casing, or other surface areas of regular shape, a preformed metal coating can consist of a metal foil adhesively-backed tape such as aluminum tape. The cylindrical and regular surfaces can be covered with the tape spirally wrapped around the case and overlapped sufficiently to effectively prevent the passage of water vapor.

The hemispherical domes on the ends of the casing, however, cannot be covered with foil tape. This is because the foil tape cannot be applied without wrinkles. Wrinkles can cause cracks in the tape that allow moisture vapor passage thus rendering the foil tape useless as a barrier against water vapor permeation.

Another factor requiring consideration in the use of a metallic moisture barrier is low weight. Any weight not absolutely required to cause the rocket motor to operate properly diminishes the efficiency thereof.

It has been proposed in the prior art to fabricate free standing metal shells for adhesive bonding to the dome ends of a composite cased solid propellant rocket motor. Such preformed shells are of complex shape and must have sufficient thickness to prevent the passage of moisture. They must also be of the lightest practical weight which is structurally strong enough to allow handling and adhesive bonding to the rocket motor case. Attempts made in the prior art to fabricate such dome covers or shells have not been successful. One technique that has been tried is spin forming. Spin forming is widely used to form complex metallic shapes and would be satisfactory except that the thickness of metal required to use this technique is approximately 0.060 inches, minimum. This is about ten times the thickness, and consequently, the weight that is desired for metallic shells to cover the dome ends of a composite cased solid propellant rocket motor.

In addition, the previously mentioned pressure testing of the composite pressure vessels, which occurs at an air or hydro pressure equal to 1.25 or more times the maximum expected operating pressure of the pressure vessel, can itself produce formation of small voids or micro cracks, fractures and the like in the motor casing leading to or permitting entry of moisture or water vapor into or through the casing.

Thus, there is a need and a demand for an improved method that can overcome the aforementioned difficulties that have been encountered in the prior art for preserving composite material cased solid propellant rocket motors against the deleterious effects of moisture or water vapor in the atmosphere. A further need is for a method of improving the moisture or water vapor barrier of composite material cased solid propellant rocket motors and for eliminating or substantially eliminating the voids, cracks and/or fracture in the motor casing produced by pressure testing of the composite pressure vessels. An additional desired result would be to provide a means for increasing the electrostatic discharge protection of a composite pressure vessel and an even more desirable result would be to provide a means for increasing both the moisture or water vapor barrier protection and the electrostatic discharge protection of a composite material cased solid propellant rocket motor.

SUMMARY OF THE INVENTION

A method to improve the moisture or water vapor barrier protection of a composite pressure vessel suitable for use as a composite cased solid propellant rocket motor comprises immersing the composite pressure vessel in a curable liquid polymer solution during pressure testing of the composite pressure vessel so that any small or micro voids, cracks or fractures may be filled with the curable liquid polymer and then curing said polymer to a solid plastic. In the case of having formed the pressure vessel on a removable mandrel, e.g. on a sand or collapsible metal mandrel, pressure testing can be done with either air or water and the curable liquid polymer solution may be a polymer which is curable at either ambient or room temperature or at an elevated temperature such as upon heating of the pressure vessel.

However, when the pressure vessel casing is formed directly in a non-removable propellant mandrel, the pressure testing of the pressure vessel must be done with air pressure and the curable liquid polymer employed must be one which is curable at or near ambient or room temperature and is preferably a UV curable liquid polymer.

Inclusion of conductive metallic flakes or powder in the curable liquid polymer can enhance the moisture or water vapor barrier produced and can enhance the electrostatic discharge protection of the vessel or casing by effectively forming an electrically conductive cage surrounding the entire casing.

DETAILED DESCRIPTION OF THE INVENTION

Composite pressure vessels or rocket motor casings are subject to pressure testing prior to use. During such pressure testing, which occurs at 1.25 or more times the maximum expected operating pressure of the vessel or casing, micro voids, cracks or fractures in the vessel or casing can be produced or generated by the proof load. Moreover, such micro voids, cracks or fractures may even be present in the vessel or casing prior to pressure testing, having been formed during production of the composite vessel or casing. Whether present initially or produced during pressure testing, these micro voids, cracks or fractures can permit the deleterious infusion of moisture or water vapor through the vessel or casing.

According to this invention, such micro voids, cracks or fractures are filled while they are "open" during pressure testing by immersing the vessel or casing in a liquid curable polymer solution to fill the micro voids, cracks or fractures in the vessel or casing with the curable polymer and which polymer is then cured to produce a vessel or casing that is "like new" or "better than new" with respect to moisture or water vapor permeability. The curable liquid polymer solution can have dispersed therein metallic flakes or powder for additional resistance to moisture or water vapor penetration which increased resistance may be produced in the vessel or casing by forming in effect a metallic barrier. Inclusion of flakes or powder of conductive metals or other electrically conductive material in the curable liquid polymer solution can also enhance the electrostatic discharge resistance of the rocket motor by forming an electrically conductive cage surrounding the entire vessel or case and propellant by having the metal or other electrically conductive material become locally attached to the fibers, e.g. graphite fibers, of the composite vessel.

Composite pressure vessels or rocket motor casings are generally produced on either a removable mandrel, e.g. sand or collapsible metal, or directly on a non-removable mandrel, e.g. propellant. In the case where the vessel or casing is produced on a removable mandrel, pressure testing of the vessel or casing can be accomplished with either air or water pressure. However, when the vessel or casing is formed directly on the propellant mandrel, the pressure testing must be done with air. In either event, according to the method of this invention, during pressure testing of the vessel or casing the vessel or casing is immersed in a bath of curable liquid polymer solution so that any voids, cracks or fractures in the vessel or casing are filled with the curable liquid polymer solution.

It will be appreciated that if the vessel or casing has been formed on a non-removable propellant mandrel, the curable liquid polymer employed should be a polymer curable at ambient or room temperature and is preferably a UV curable liquid polymer. Alternatively, if the vessel or casing has been formed on a removable mandrel, the curable liquid polymer need not be curable at an ambient or room temperature but may be curable at either ambient, room temperature or at an elevated temperature, such as by heating. Thus, with the foregoing proviso, the invention contemplates the use of any suitable curable liquid polymer solution as the bath into which the pressure vessel or casing is immersed during pressure testing thereof.

For example, as an ambient or room temperature curable liquid polymer suitable for use in this invention, there may be mentioned modified acrylated epoxy resins such as, for example, ACCUSETTM TM FMD-180/181 resin, available from Loctite Corporation, which fully cures rapidly (within 72 hours) at room temperature (about 72° F. or 22° C.) when exposed to long wavelength UV light (365 nm). This resin may also be employed when elevated temperature cure is permissible, i.e. on vessel or casing formed on removable mandrels, and cures more rapidly; for example, it cures in about 1 hour at 125° C. Another such suitable liquid polymer curable at ambient or room temperature upon exposure to UV radiation is ACCUSETTM TM FMD-148 resin from Loctite Corporation which is an epoxy resin containing about 15-20% by weight of a multifunctional acrylate ester and 1-3% by weight of a photoinitiator.

A wide variety of high temperature curable polymer may be employed in the polymer bath for pressure testing of vessels or casings formed on removable mandrels. In addition to the previously mentioned UV curable resins which can also be cured at elevated temperatures, if desired, other known liquid polymers curable at elevated temperatures may be employed. For example, any suitable liquid epoxy resins containing amine or anhydride curing agents activated at elevated temperature can be employed. Any suitable thermosetting curable liquid polymer may be employed in the process of this invention. However, preferably the curable liquid resin is one which is UV curable at ambient or room temperature, more preferably a liquid epoxy resin and most preferably an acrylated epoxy resin.

When flakes or powder of metal or other electrically conductive material is included in the liquid polymer both additional resistance to moisture or water vapor penetration into the vessel or casing and enhanced electrostatic discharge resistance of the rocket motor may be obtained. Any suitable metal powder or flakes, preferably electrically conductive powder or flakes of aluminum, copper or silver may be employed according to this invention. As an example of non-metallic or other electrically conductive material suitable for use as the process of this invention there may be mentioned chopped graphite fibers.

With the foregoing description of the invention, those skilled in the art will appreciate that modifications may be made to the invention without departing from the spirit thereof. Therefore, is is not intended that the scope of the invention be limited to the specific embodiments illustrated and described.

We claim:

1. A method for improving the moisture barrier protection of a composite pressure vessel comprising immersing the composite pressure vessel in a curable liquid polymer solution during pressure testing of said vessel so that said curable liquid polymer solution flows into voids, cracks or fractures in said pressure vessel and subsequently curing said liquid polymer in said voids, cracks or fractures.

2. A method according to claim 1 wherein the curable liquid polymer is a polymer curable at ambient or room temperature.

3. A method according to claim 2 wherein the curable liquid polymer is UV curable.

4. A method according to claim 2 wherein the curable liquid polymer is an acrylated epoxy polymer.

5. A method according to claim 4 wherein the acrylated epoxy polymer is curable at ambient or room temperature when exposed to long wavelength UV light of about 365 nm.

6. A method according to claim 1 wherein the curable liquid polymer is a polymer curable at an elevated temperature.

7. A method according to claim 1 wherein the curable liquid polymer solution also contains electrically conductive material.

8. A method according to claim 2 wherein the curable liquid polymer solution also contains electrically conductive material.

9. A method according to claim 3 wherein the curable liquid polymer solution also contains electrically conductive material.

10. A method according to claim 4 wherein the curable liquid polymer solution also contains electrically conductive material.

11. A method according to claim 5 wherein the curable liquid polymer solution also contains electrically conductive material.

12. A method according to claim 6 wherein the curable liquid polymer solution also contains electrically conductive material.

13. A method according to claim 7 wherein the electrically conductive material is metallic flakes or powder.

14. A method according to claim 8 wherein the electrically conductive material is metallic flakes or powder.

15. A method according to claim 9 wherein the electrically conductive material is metallic flakes or powder.

16. A method according to claim 10 wherein the electrically conductive material is metallic flakes or powder.

17. A method according to claim 11 wherein the electrically conductive material is metallic flakes or powder.

18. A method according to claim 12 wherein the electrically conductive material is metallic flakes or powder.

19. A method according to claim 1 wherein the composite pressure vessel immersed in the curable liquid polymer solution during pressure testing of said vessel is a composite pressure vessel formed on a non-removable propellant mandrel.

20. A method according to claim 2 wherein the composite pressure vessel immersed in the curable liquid polymer solution during pressure testing of said vessel is a composite pressure vessel formed on a non-removable propellant mandrel.

21. A method according to claim 3 wherein the composite pressure vessel immersed in the curable liquid polymer solution during pressure testing of said vessel is a composite pressure vessel formed on a non-removable propellant mandrel.

22. A method according to claim 4 wherein the composite pressure vessel immersed in the curable liquid polymer solution during pressure testing of said vessel is a composite pressure vessel formed on a non-removable propellant mandrel.

23. A method according to claim 5 wherein the composite pressure vessel immersed in the curable liquid polymer solution during pressure testing of said vessel is a composite pressure vessel formed on a non-removable propellant mandrel.

24. A method according to claim 7 wherein the composite pressure vessel immersed in the curable liquid polymer solution during pressure testing of said vessel is a composite pressure vessel formed on a non-removable propellant mandrel.

25. A method according to claim 5 wherein the composite pressure vessel immersed in the curable liquid polymer solution during pressure testing of said vessel is a composite pressure vessel formed on a non-removable propellant mandrel.

26. A method according to claim 9 wherein the composite pressure vessel immersed in the curable liquid polymer solution during pressure testing of said vessel is a composite pressure vessel formed on a non-removable propellant mandrel.

27. A method according to claim 10 wherein the composite pressure vessel immersed in the curable liquid polymer solution during pressure testing of said vessel is a composite pressure vessel formed on a non-removable propellant mandrel.

28. A method according to claim 11 wherein the composite pressure vessel immersed in the curable liquid polymer solution during pressure testing of said vessel is a composite pressure vessel formed on a non-removable propellant mandrel.

29. A method for improving the moisture barrier protection and electrostatic discharge protection of a composite pressure vessel comprising immersing the composite pressure vessel in a curable liquid polymer solution containing electrically conductive flakes or powder during pressure testing of said pressure vessel so that said curable liquid polymer solution flows into voids, cracks or fractures in said pressure vessel and subsequently curing said liquid polymer in said voids, cracks or fractures.

30. A method according to claim 29 wherein the curable liquid polymer is a polymer curable at ambient or room temperature.

31. A method according to claim 29 wherein the composite pressure vessel immersed in the curable liquid polymer solution during pressure testing of said vessel is a composite pressure vessel formed on a non-removable propellant mandrel.

32. A method according to claim 30 wherein the composite pressure vessel immersed in the curable liquid polymer solution during pressure testing of said vessel is a composite pressure vessel formed on a non-removable propellant mandrel.

33. A pressure vessel produced by the process of claim 1.

34. A pressure vessel produced by the process of claim 29.

35. A pressure vessel produced according to the process of claim 19.

36. A pressure vessel produced according to the process of claim 31.

* * * * *